US011434662B2

(12) United States Patent
Dirnberger et al.

(10) Patent No.: US 11,434,662 B2
(45) Date of Patent: Sep. 6, 2022

(54) DOOR LATCH FOR AN ELECTRICAL DOMESTIC APPLIANCE

(71) Applicant: emz-Hanauer GmbH & Co. KGaA, Nabburg (DE)

(72) Inventors: Albert Dirnberger, Neunburg vorm Wald (DE); Georg Spiessl, Altendorf (DE); Matthias Bauer, Schmidgaden (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 1025 days.

(21) Appl. No.: 16/030,904

(22) Filed: Jul. 10, 2018

(65) Prior Publication Data

US 2019/0040654 A1 Feb. 7, 2019

(30) Foreign Application Priority Data

Jul. 13, 2017 (DE) ..... 10 2017 006 649.3

(51) Int. Cl.
*E05B 47/06* (2006.01)
*D06F 39/14* (2006.01)
(Continued)

(52) U.S. Cl.
CPC ..... *E05B 47/0603* (2013.01); *D06F 37/42* (2013.01); *D06F 39/14* (2013.01);
(Continued)

(58) Field of Classification Search
CPC ..... Y10S 292/69; Y10S 292/1047; Y10S 292/1082; E05B 47/06; E05B 2047/0014;
(Continued)

(56) References Cited

U.S. PATENT DOCUMENTS 6,279,972 B1 * 8/2001 Brill ..... E05B 77/26 292/216
2004/0232706 A1 * 11/2004 Kurten ..... E05B 81/14 292/216

(Continued)

FOREIGN PATENT DOCUMENTS

DE 3919458 A1 12/1990
DE 19601230 A1 * 7/1997 ..... D06F 37/42

(Continued)

OTHER PUBLICATIONS

German search report in counterpart application DE 10 2017 006 649.3, dated Apr. 6, 2018.

(Continued)

*Primary Examiner* — Christine M Mills
*Assistant Examiner* — Peter H Watson
(74) *Attorney, Agent, or Firm* — Hayes Soloway PC

(57) ABSTRACT

A door latch for an electrical domestic appliance includes a rotary member arranged to be rotationally movable between a closing rotational position and a release rotational position and is spring-biased in the direction towards the release rotational position, a movably arranged catch that is in an arresting engagement with the rotary member when the rotary member is in the closing rotational position, and a locking assembly that includes a movable locking member movable between an unlocking position and a locking position. The arresting engagement is releasable by an overlifting rotational movement of the rotary member. The rotary member is rotationally movable between a closing rotational position and a release rotational position and is spring-biased in the direction towards the release rotational position. The locking member, when transferred from the unlocking position into the opening position, causes the (Continued)

arresting engagement of the catch with the rotary member to be released.

10 Claims, 6 Drawing Sheets

(51) Int. Cl.

| | |
|---|---|
| ***E05C 19/02*** | (2006.01) |
| ***E05B 47/00*** | (2006.01) |
| ***E05C 3/24*** | (2006.01) |
| ***D06F 37/42*** | (2006.01) |

(52) U.S. Cl.
CPC ..... *E05B 47/0012* (2013.01); *E05C 3/24* (2013.01); *E05C 19/024* (2013.01); *E05B 2047/002* (2013.01); *E05B 2047/0086* (2013.01); *E05Y 2900/312* (2013.01)

(58) Field of Classification Search
CPC ..... E05B 47/0012; E05B 2047/0086; E05B 65/00; E05B 2047/0015; E05B 2047/0016; E05B 2047/0036; E05B 2047/0081; E05B 47/0603; D06F 37/28; D06F 39/14; E05C 3/30; E05Y 2900/312
See application file for complete search history.

(56) References Cited

U.S. PATENT DOCUMENTS

| | | | | |
|---|---|---|---|---|
| 2015/0345190 | A1* | 12/2015 | Dow | E05B 81/34 292/200 |
| 2016/0251881 | A1* | 9/2016 | Dirnberger | E05B 65/00 292/195 |
| 2017/0145613 | A1* | 5/2017 | Choi | E05B 17/2007 |
| 2018/0008120 | A1* | 1/2018 | Dirnberger | A47L 15/4259 |
| 2018/0163433 | A1* | 6/2018 | Schmidt | E05C 3/22 |
| 2019/0024287 | A1* | 1/2019 | Kim | D06F 37/42 |
| 2019/0264466 | A1* | 8/2019 | Xu | E05B 65/5253 |

FOREIGN PATENT DOCUMENTS

| | | | | |
|---|---|---|---|---|
| DE | 19601230 | A1 | 7/1997 | |
| DE | 102007033451 | B4 | 9/2011 | |
| DE | 202015100627 | U1 | 6/2015 | |
| DE | 102015002538 | B3 | 3/2016 | |
| EP | 1460163 | A2 * | 9/2004 | D06F 37/42 |
| EP | 1460163 | B1 | 1/2009 | |
| KR | 101856382 | B1 * | 5/2018 | |
| WO | WO-2012123980 | A1 * | 9/2012 | E05C 3/16 |

OTHER PUBLICATIONS

Chinese office action with English translation in counterpart application CN 201710982675.4, dated Jun. 30, 2020.

* cited by examiner

DOOR LATCH FOR AN ELECTRICAL DOMESTIC APPLIANCE

BACKGROUND OF THE INVENTION

1. Field of the Invention

The present invention relates generally to a door latch for an electrical domestic appliance. Particularly, the present invention relates to a door latch for a laundry treatment appliance.

2. Description of the Prior Art

The door latches considered within the context of the present disclosure comprise a rotary member which is arranged to be rotationally movable between a closing rotational position and a release rotational position and is spring-biased in the direction towards the release rotational position and which, in the closing rotational position, holds a closure member in order to keep a door of the domestic appliance closed and, in the release rotational position, releases the closure member in order for the door to open. The door latches of the type under consideration here further comprise a movably arranged catch for arresting engagement, which is releasable by an overlifting rotational movement of the rotary member, with the rotary member in the closing rotational position thereof.

A conventional door latch of the type discussed above is described, for example, in DE 39 19 458 A1. According to that document, the conventional door latch described therein is intended in particular for use in a tumble dryer. Although a secure closing function of the door latch is routinely desired in the case of tumble dryers, the latch is usually not required additionally to be able to lock the closed door during operation of the tumble dryer. On the contrary, the requirement profile in the case of tumble dryers is often that the door can also be opened by a user during the drying operation, for example in order to introduce further wet laundry or in order to be able to check the degree of dryness of the laundry in the dryer.

In contrast to tumble dryers, it is routinely required in the case of washing machines for domestic use that the closed door is capable of being locked during washing operation of the washing machine. The user is to be protected from contact with the washing water, which is usually at a temperature of up to 90 degrees or 95 degrees; washing water is also to be prevented from escaping from the washing vessel of the machine. Therefore, a user should not usually be able to open the washing machine door during the washing operation.

In the case of the conventional door latch according to DE 39 19 458 A1, a total of three possibilities for opening the door are given. One of these possibilities, according to the explanations given in DE 39 19 458 A1, consists in a user actuating a button, whereupon the door is opened with the aid of an electromagnet. If the electromagnet is actuated, a push rod of the electromagnet meets an arm of the catch, whereby the catch is tilted out of engagement with the rotary member and the rotary member is released for rotation back into the release rotational position.

With regard to the prior art relating to overlifting door latches, reference is additionally made to DE 10 2007 033 451 B4, DE 196 01 230 A1 and EP 1 460 163 B1.

SUMMARY OF THE INVENTION

It is an object of the invention to equip an overlifting door latch with a suitable locking mechanism so that the latch is suitable for use in a washing machine. The door latch is to provide the possibility of controlled opening of the latch and is to have as simple a construction as possible.

In order to achieve that object, a door latch of the type described above further comprises, according to the invention and in conformity with independent claim 1, a locking assembly having a locking member which is arranged to be movable, when the door is closed, between an unlocking position and a locking position and which blocks at least one movable component of the door latch in the locking position and releases that component in the unlocking position. The locking member is thereby movable, starting from the locking position, beyond the unlocking position into an opening position and, when moved into the opening position, causes the arresting engagement of the catch with the rotary member to be released. Controlled opening of the door latch can accordingly be effected in the case of the solution according to the invention by moving the locking member. A single actuator acting on the locking member is consequently sufficient on the one hand to move the door latch into a locked state (by moving the locking member into its locking position) and on the other hand not only to unlock but also to open the door latch (by moving the locking member into its opening position, for example upon unlocking). Separate actuators for the functions of locking, on the one hand, and controlled opening, on the other hand, are therefore not required; this simplifies the construction of the door latch.

In some embodiments, the locking member is stably movable into the opening position. Stable here means that the locking assembly is so configured that the locking assembly does not have to be continuously activated (fed with current) in order to hold the locking member in the opening position. For this purpose, the locking assembly can comprise, for example, an electric drive motor for driving the locking member. The drive motor (e.g. a step motor) can be switched off temporarily once the locking member has reached its opening position. As long as the drive motor is switched off, the locking member remains in its opening position and only leaves it again when the drive motor is actuated again. Of course, it is not necessary for the drive motor to be switched off for a prolonged period or at all once the locking member has reached its opening position. For the purposes of controlled door opening it is sufficient to control the drive motor in such a manner that the locking member, immediately after reaching the opening position, is moved out of the opening position again and, for example, moved into its unlocking position.

In other embodiments, the construction of the locking assembly is such that the locking member, for stable movement into the unlocking position, performs a forced pass through the opening position starting from the locking position. Accordingly, in these embodiments, a forced opening of the door latch takes place when the door latch is unlocked and the locking member is brought out of the locking position into the unlocking position. For such a configuration, the locking assembly can comprise an electromagnetic drive unit for driving the locking member, the locking member having an associated sliding guide defining the unlocking position, the locking position and the opening position. The sliding guide is in such a form that a first control pulse for the electromagnetic drive unit (i.e. a first short-time current feed to the electromagnet) effects a transfer of the locking member out of the unlocking position into the locking position. A subsequent second control pulse then effects a transfer of the locking member out of the locking position into the opening position, before the locking member stably reaches the unlocking position. The opening position is therefore passed through only during unlocking of the door latch, but not during locking of the door latch.

In some embodiments, the locking member cooperates directly with the catch. In other embodiments, the locking member cooperates only indirectly with the catch, namely via at least one intermediate member which is movable into the opening position independently of a movement of the locking member and which has a release structure which is provided for engagement with the catch in order to free the rotary member from arresting engagement by the catch.

In some embodiments, the locking member, upon moving into the opening position, causes the catch to be lifted out of contact with the rotary member. The catch is accordingly lifted away from the rotary member, in particular against the action of a spring which biases the catch in contact with a peripheral surface of the rotary member.

The arresting engagement of the catch with the rotary member can be released by the engagement of sloped surfaces of two cooperating components which are situated in the force transmission path from the locking member to the catch. In this respect, some embodiments comprise a release structure, which cooperates with the catch and is movable into the opening position independently of a movement of the locking member, for releasing the arresting engagement of the catch with the rotary member by means of the sloped-surface engagement between the release structure and the catch. A sloped surface can thereby be formed only on the release structure or only on the catch or on both components. The release structure can be formed directly on the locking member; alternatively, it can be formed on a release member which is separate from the locking member and the movement of which is controlled by the locking member.

It has been mentioned above that the locking member blocks at least one movable component of the door latch in the locking position. That component can be, for example, the rotary member, which can be blocked by the locking member against rotation into the release rotational position. Alternatively or in addition, the locking member in its locking position can block the catch in at least one movement direction.

The invention will be explained further hereinbelow with reference to the accompanying drawings.

DETAILED DESCRIPTION OF THE INVENTION

Figure 1A:
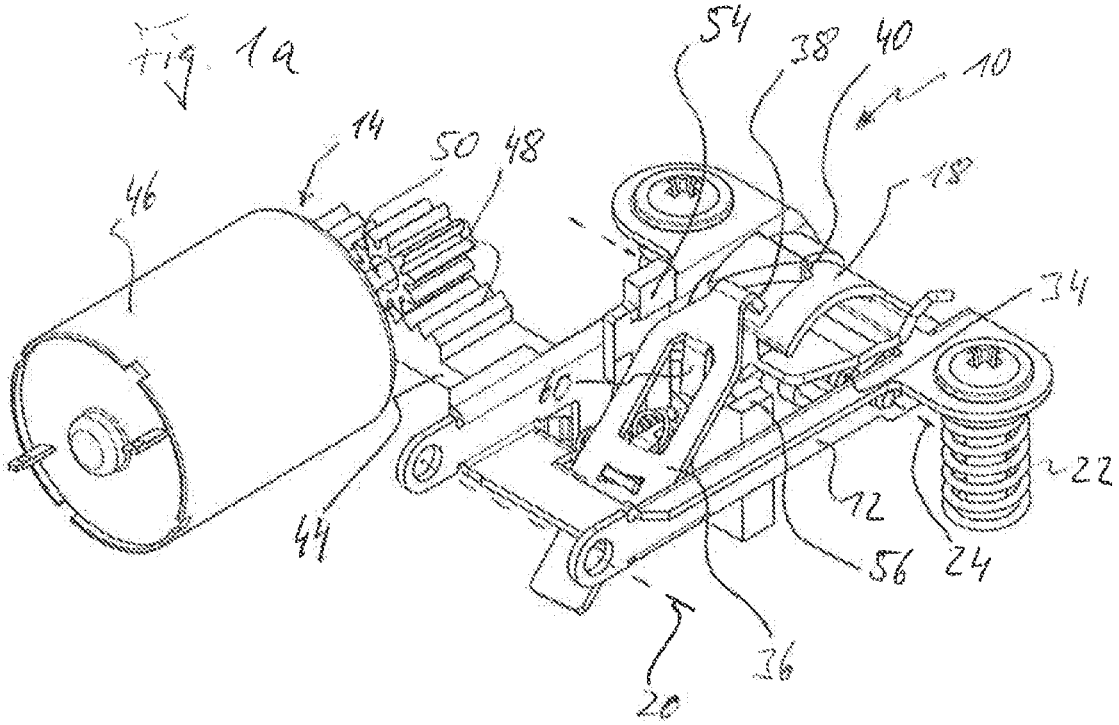
FIGS. 1*a* and 1*b* are two views of a door latch according to a first embodiment in an open state with the door open.
Figure 1B:
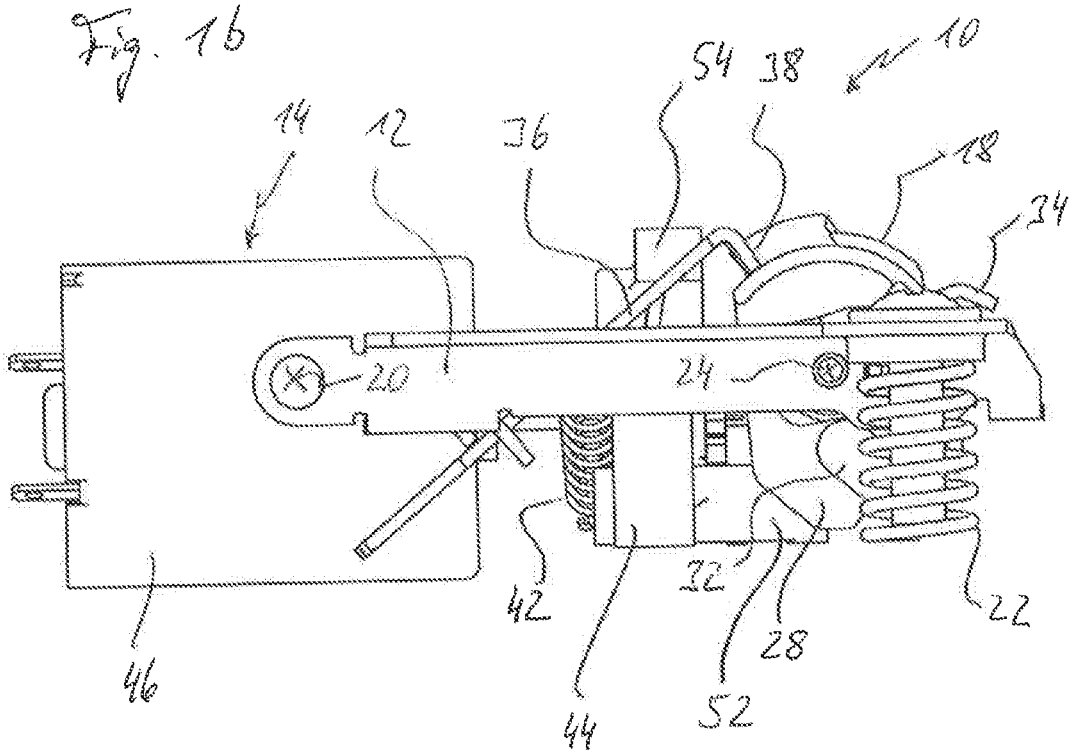
Figure 2A:
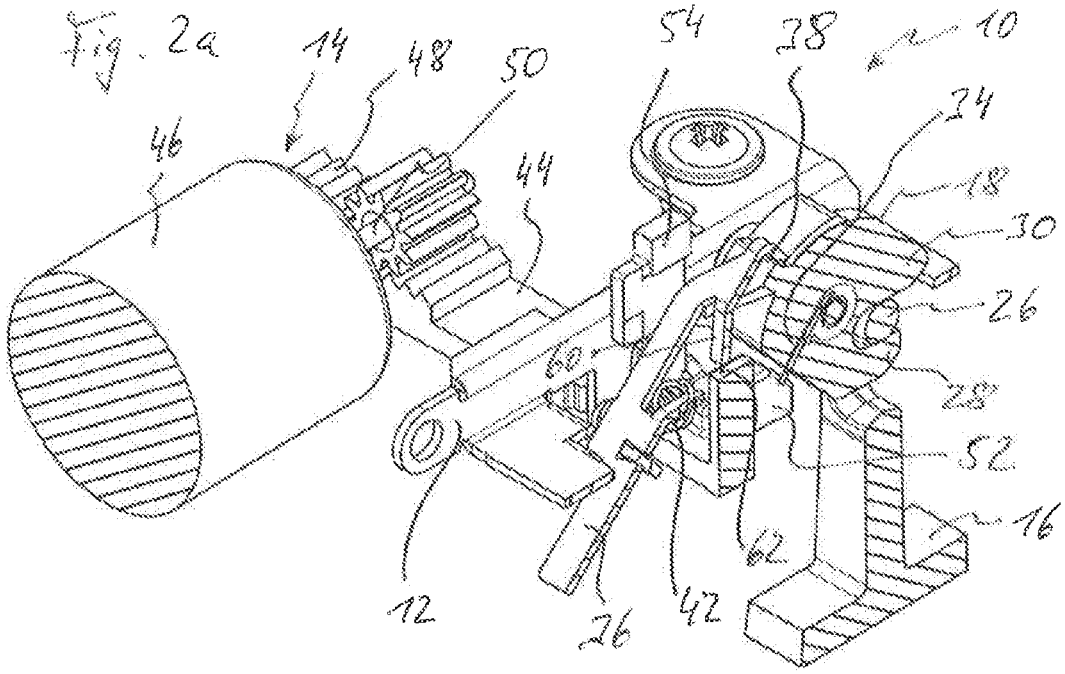
FIGS. 2*a* and 2*b* are two views of the door latch according to the first embodiment corresponding to the views of FIGS. 1*a*, 1*b* in a closed but unlocked state.
Figure 2B:
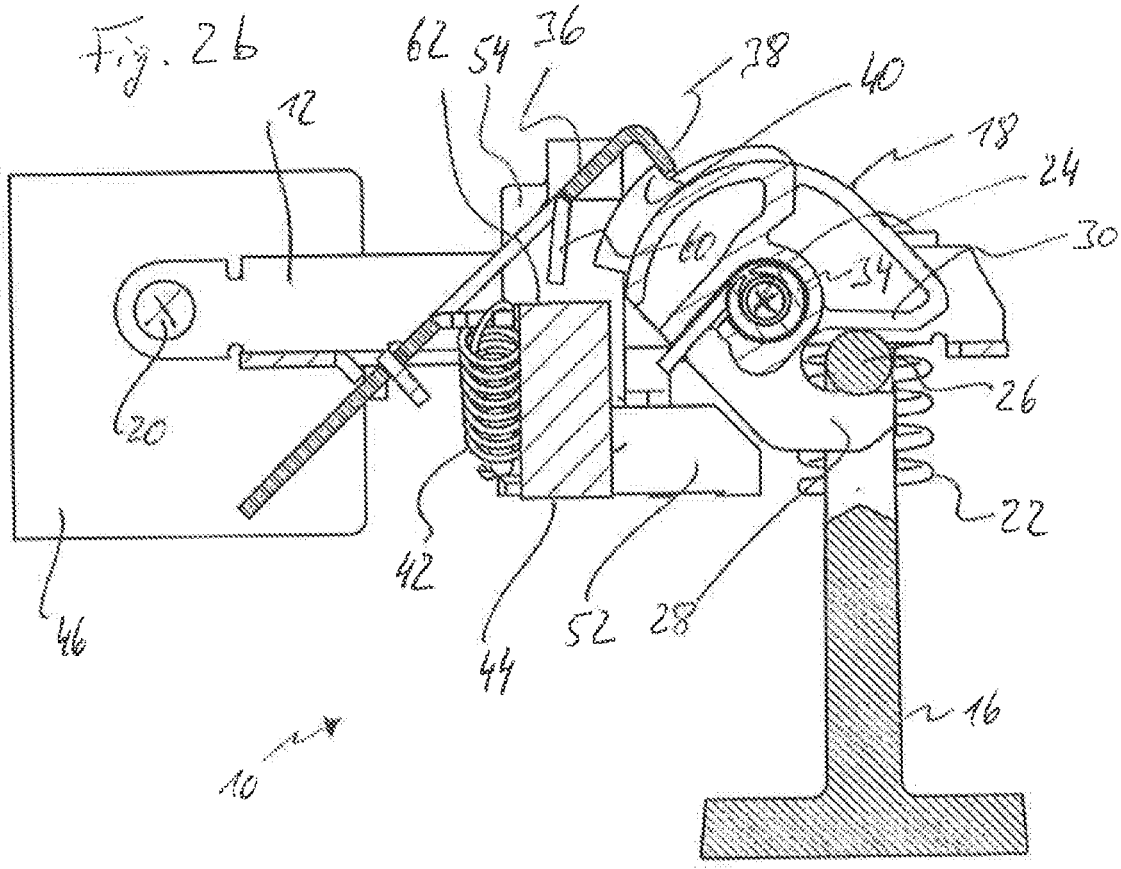
Figure 3A:
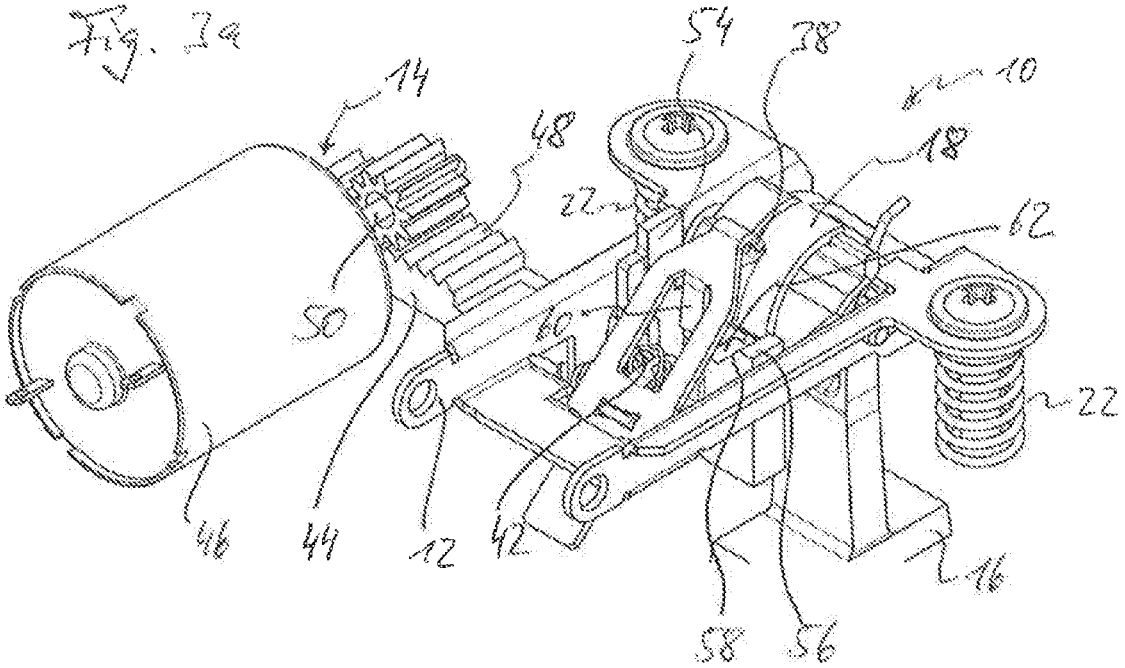
FIGS. 3*a* and 3*b* are two views of the door latch of the first embodiment corresponding to the views of FIGS. 1*a*, 1*b* in a closed and locked state.
Figure 3B:
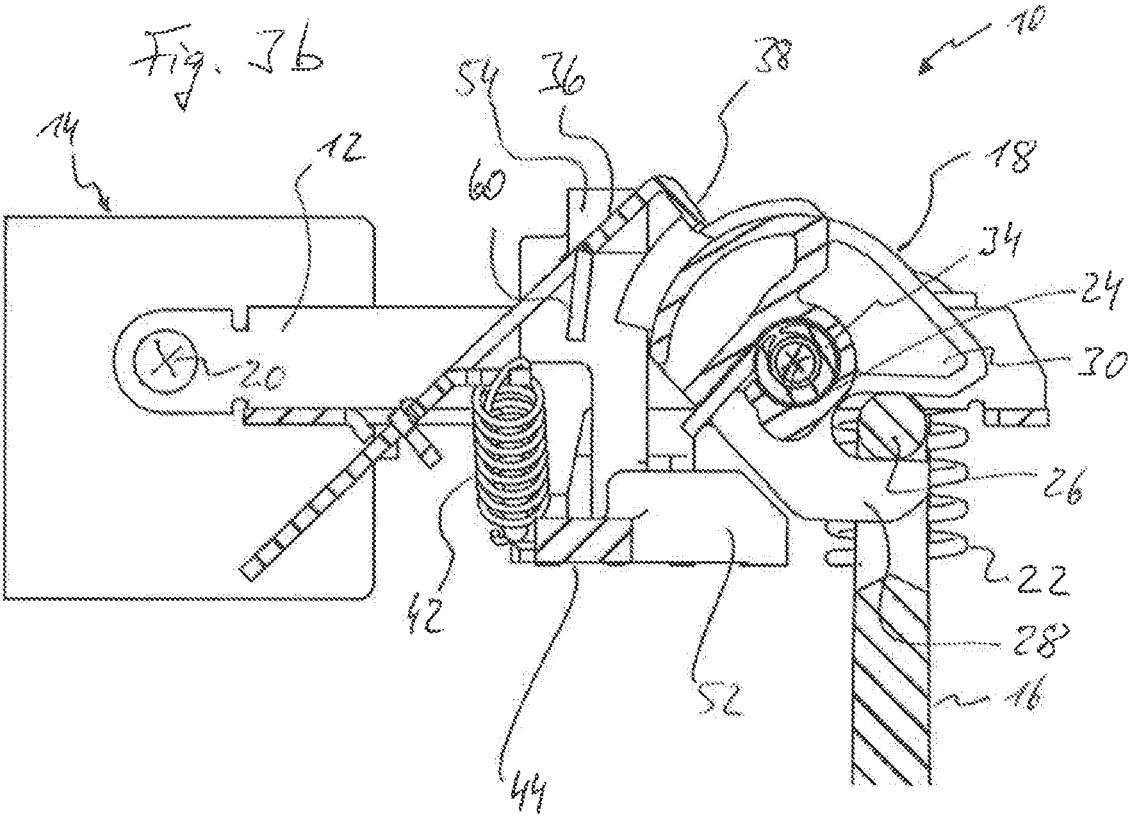
Figure 4A:
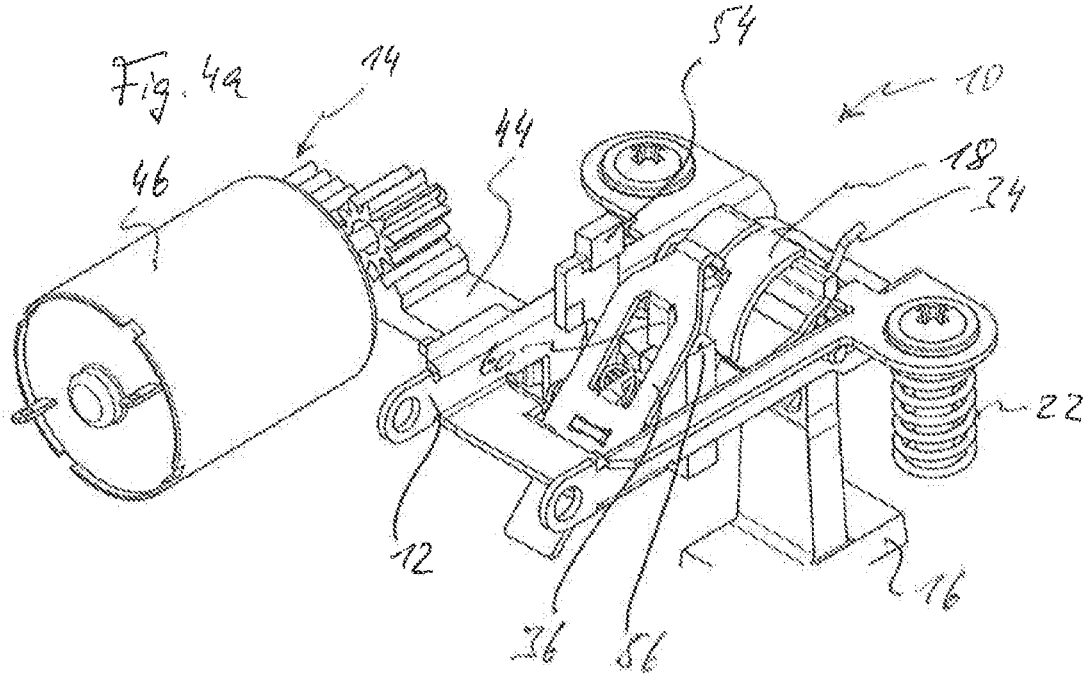
FIGS. 4*a* and 4*b* are two views of the door latch of the first embodiment corresponding to the views of FIGS. 1*a*, 1*b* in a state in the case of forced opening of the latch.
Figure 4B:
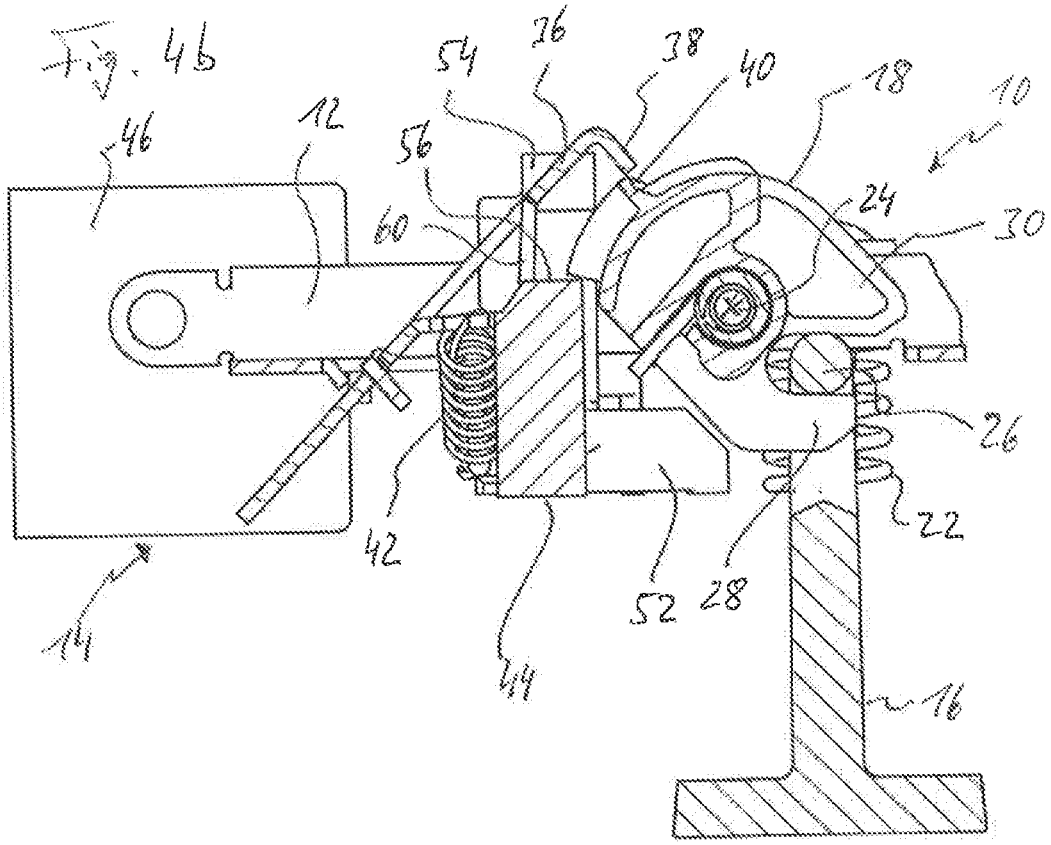

The first embodiment, which is shown in FIGS. 1*a* to 5*c*, will be explained first. The door latch 10 shown therein is generally designated 10. It comprises a latch housing, which is not shown in detail in the figures, in which a carrier lever 12 and a locking assembly 14 are accommodated. The door latch 10 is provided for fitting into a domestic washing machine, for example, whereby the mentioned latch housing is to be fixed, for example, to a machine wall of a machine main body, in which a washing vessel (drum or barrel) is rotatably mounted. A closure member 16 (see e.g. FIGS. 2*a* and 2*b*) is attached to a door, which is pivotably mounted on the machine main body and serves to close an access opening to the washing vessel, which closure member enters an insertion opening formed in the latch housing when the door is closed and cooperates with a rotary member 18, which can be also be referred to as a gripper, arranged on the carrier lever 12. It will be appreciated that a reverse assembly pattern can be chosen as an alternative, that is to say the closure member 16 can be mounted on the machine main body and the latch housing with the components accommodated therein can be fixed to the door.

The carrier lever 12 is mounted on the mentioned latch housing to be pivotable about a pivot axis 20 and is biased into a rest position by a spring arrangement formed in the example shown by two helical compression springs 22. The rotary member 18 is mounted on the carrier lever 12 to be rotatable about a rotation axis 24 which is parallel to the pivot axis 20. When the door is open, the rotary member 18 assumes a release rotational position which is visible in FIG. 1*b*, in which it is ready for a transverse stirrup 26 of the closure member 16 to enter a gripping mouth 32, delimited by two jaws 28, 30, of the rotary member 18. The closure member 16 thereby first comes into contact with its transverse stirrup 26 with the jaw 30 and thereby initiates a rotation of the rotary member 18 about the rotation axis 24 against the force of a biasing spring 34, which is formed in the example shown by a leg spring and which biases the rotary member 18 into the release rotational position. As the rotary member 18 rotates, the jaw 28 moves behind the transverse stirrup 26 of the closure member 16. As soon as the rotary member 18 reaches a closing rotational position shown in FIG. 2*b*, a catch 36 pivotably held on the carrier lever 12 engages by means of a nose 38 behind an arresting edge 40 formed on a peripheral surface of the rotary member 18 and thus prevents the rotary member 18 from rotating back in the direction towards the release rotary position.

The arresting edge 40 is part of a sliding guide which is formed on the peripheral surface of the rotary member 18 and which allows the door latch 10 to be opened by an overlift (renewed pushing against the door of the washing machine from outside). If, starting from the closed state according to FIGS. 2*a*, 2*b*, the user pushes against the door, this causes the rotary member 18 to rotate beyond the closing rotational position (overlifting rotational movement). The sliding guide is in such a form that, in the case of such an overlifting rotational movement of the rotary member 18, the nose 38 of the catch 36 springs away from the arresting edge 40 sideways, under the action of a biasing spring 42 acting on the catch 36. The nose 38 which springs away is urged by the biasing spring 42 onto a portion of the sliding guide that does not offer any possibility of arresting the rotary member 18. If the user then removes the pressure from the door, the rotary member 18 rotates under the action of its biasing spring 34 back in the direction towards the release rotational position. Because the nose 36 of the catch 38 thereby no longer has an arresting hold on the peripheral surface of the rotary member 18, the rotary member 18 rotates beyond the closing rotational position into the release rotational position according to FIGS. 1*a*, 1*b*. For further details of the sliding guide formed on the outer periphery of the rotary member 18, reference is made by way of example to DE 39 19 458 A1, in particular as regards the explanations in relation to FIGS. 3 to 5 therein.

The locking assembly 14 allows the door latch to be locked in the closed state. In the locked state, the latch cannot be opened by overlifting. Even if the user pushes against the door from outside when the door is locked, the door remains closed.

The locking assembly 14 comprises a locking member 44 which in the example shown is in the form of a linearly movable locking slider which is arranged to be displaceable linearly in a sliding direction parallel to the rotation axis 24 of the rotary member 18. For driving the locking slider 44, the locking slider has an associated locking actuator which, in the first embodiment according to FIGS. 1*a* to 5*c*, comprises an electric drive motor 46 (e.g. a step motor). In the example shown, the locking slider 44 has a toothed portion 48, with which a drive shaft 50 of the drive motor 46 is in interlocking engagement. A plurality of structures, the function of which is to lock and force-open the latch 10, is formed on the locking slider 44. Specifically, in the example shown, those structures include a first blocking structure (blocking arrangement) 52, a second blocking structure 54 and a release structure 56. The first blocking structure 52 serves to block the rotary member 18 in its closing rotational position against rotation back into the release rotational position. In the locked state according to FIGS. 3*a*, 3*b*, the first blocking structure 52 has accordingly moved into the rotation path of the rotary member 18 (see FIG. 3*b*), so that, even if the arresting engagement of the nose 38 of the catch 36 with the rotary member 18 is lost (e.g. as a result of vibrations), the rotary member 18 is blocked by the first blocking structure 52 against rotation into the release rotational position. In the unlocked state, on the other hand, the first blocking structure 52 has moved out of the rotation path of the rotary member 18 and does not prevent the rotary member 18 from rotating from the closing rotational position into the release rotational position.

The second blocking structure 54 serves to block the catch 36 against lateral pivoting in the case of attempted overlifting opening. In the locked state, the second blocking structure 54 specifically prevents such lateral pivoting of the catch 36, by means of which the nose 38 would pivot onto a portion of the sliding guide of the rotary member 18 on which the catch 36 is no longer able to arrest the rotary member 18 in its closing rotational position. If, in the locked state of the door latch 10, the user pushes against the door, this leads to an overlifting rotational movement of the rotary member 18 but, because the catch 36 is blocked against lateral pivoting by the second blocking structure 54, the nose 38 of the catch 36 comes into arresting engagement with the arresting edge 40 of the rotary member 18 again when the user removes the pressure against the door. In the unlocked state of the door latch 10, the second blocking structure 54 is out of range of the catch 16 and does not stand in the way of lateral pivoting thereof, as is required for a normal overlifting opening operation.

The release structure 56 does not have a locking function but a release function (opening function). It allows forced-opening of the door latch 10 to be effected by displacement of the locking slider 44 into an opening position which, when seen from the locking position, lies beyond the unlocking position. For this purpose, the release structure 56 has a release ramp 58 which forms a ramp surface which slopes upwards at an angle to the sliding direction of the locking slider 44. When the locking member 44 is moved out of the unlocking position into the mentioned opening position, the release ramp cooperates with a tongue 60 formed on the catch 36, in the manner of a sloped-surface engagement. Because of the upward slope of the release ramp 58, the catch 36 is lifted out of engagement with the rotary member 18 as soon as the release ramp 58, when the locking slider 44 is transferred into the opening position, strikes the tongue 60, so that the nose 38 of the catch 36 comes out of engagement with the sliding guide of the rotary member 18. As a result of this lifting of the catch 36, the rotary member 18 is free to rotate into the release rotational position.

Figure 5A:
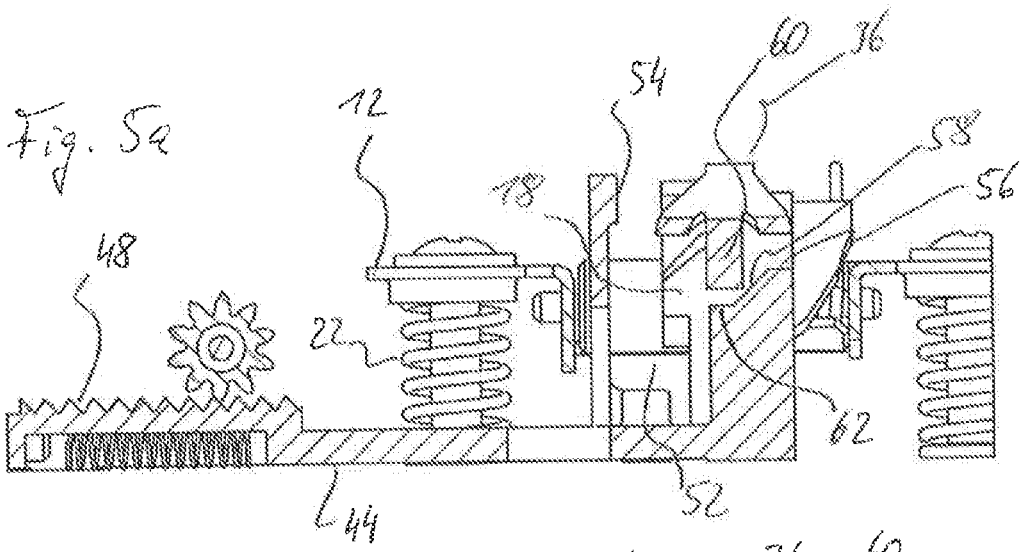
FIGS. 5*a*, 5*b* and 5*c* are views which illustrate different positions of a locking member of the door latch of the first embodiment.
Figure 5B:
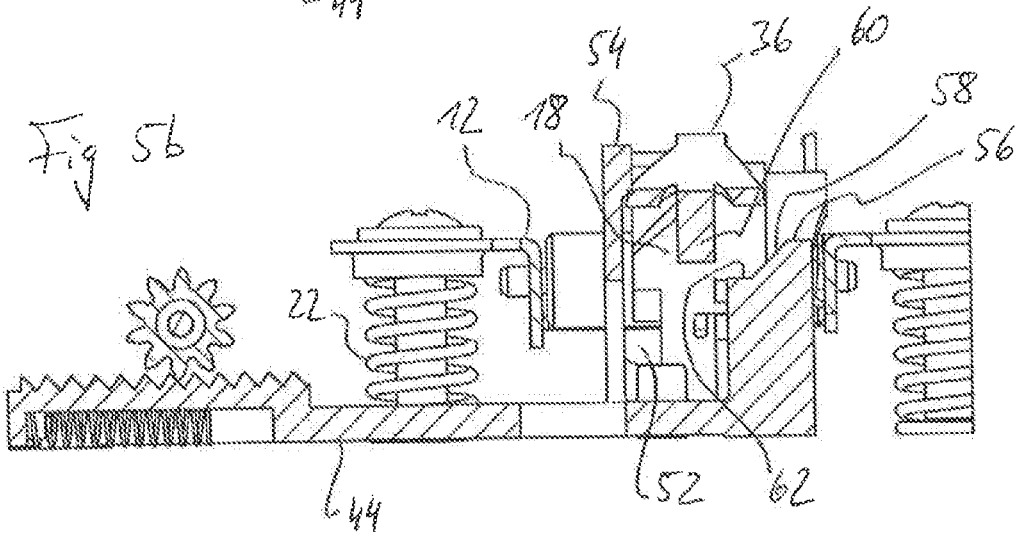
Figure 5C:
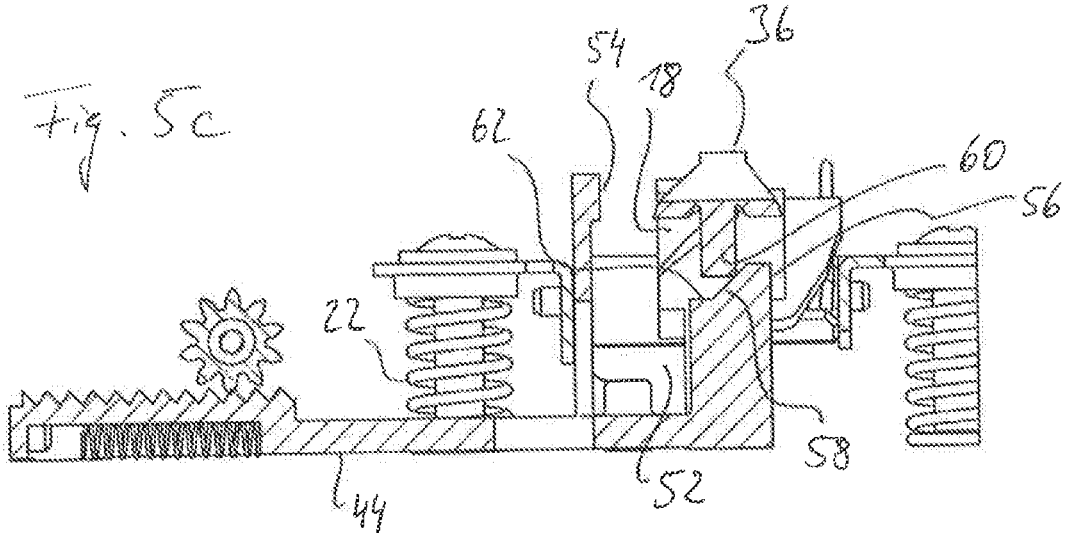

FIGS. 5*a* to 5*c* show the mentioned positions of the locking slider 44 (unlocking position, locking position, opening position). FIG. 5*a* shows the unlocked state with the door closed. The first blocking structure 52 and the second blocking structure 54 are inoperative; the release ramp 58 is also out of engagement with the tongue 60 of the catch 36. On locking, the locking slider 44 is moved to the right in the representation of FIG. 5*a* relative to the carrier lever 12 and the components rotary member 18 and catch 36 arranged thereon, into the locking position. FIG. 5*b* shows the locked state of the door latch 10. In this state, the second blocking structure 54 has moved towards the catch 36 and blocks it against lateral pivoting. The first blocking structure 52 blocks the rotary member 18 against rotation back into the release rotational position. The release structure 56 having the release ramp 58 is even further away from the tongue 60 of the catch 36 than in the unlocking position of the locking slider 44.

After completion of a wash program of the washing machine, a control unit, which is not shown in detail in the drawings, controls the drive motor 46 for displacement of the locking slider 44 in such a manner that the door latch 10 is not only unlocked but additionally force-opened. For that purpose, the locking slider 44 is displaced to the left relative to the carrier lever 12 in the representation of FIG. 5*b*, beyond the unlocking position according to FIG. 5*a*, until the release ramp 58 meets the tongue 60 of the catch 36 and, because of the sloped-surface engagement between the release ramp 58 and the tongue 60, the catch 36 is lifted out of engagement with the rotary member 18. This situation is shown in FIG. 5*c* and corresponds to the opening position of the locking slider 44.

After the forced-opening of the door latch 10, the mentioned control unit controls the locking slider 44 into its unlocking position according to FIG. 5*a* again, by corresponding actuation of the drive motor 46, so that the latch 10 is ready again for closing of the door.

The release structure 56, in addition to the release ramp 58, forms a release stop 62 which, in the unlocking position of the locking slider 44, is in an active position beneath the tongue 60 of the catch 36. The release stop 62 serves for the emergency opening of the door latch 10 when the door is closed but unlocked, by pressing against the door from inside. The carrier lever 12 is thereby pivoted out of the rest position against the force of the springs 22. The rotary member 18 held on the carrier lever 12 moves with the carrier lever 12 as it is pivoted. Because the catch 36 is biased by the biasing spring 42 into engagement with the outer periphery of the rotary member 18, the catch 36 also moves until the tongue 60 meets the release stop 62. With continued pivoting of the carrier lever 12, the catch 36, as a result of the tongue 60 meeting the release stop 62, is lifted out of arresting engagement with the rotary member, so that the rotary member 18 is able to rotate out of the closing rotational position back into the release rotational position and the door latch 10 is opened. In the locking position of the locking slider 44, on the other hand, the release stop 62 is out of reach of the tongue 60 (see FIG. 5*b*), so that the emergency opening function of the door latch 10 is not available in the locked state.

Reference will now be made to the second embodiment according to FIGS. 6*a*, 6*b*. In those figures, elements which are the same or have the same effect are provided with the same reference numerals as in FIGS. 1*a* to 5*c*, but with the addition of a lowercase letter. Unless indicated otherwise hereinbelow, reference is made for the explanation of such elements to the preceding remarks relating to the first embodiment.

The second embodiment differs from the first embodiment substantially by in the form of the locking assembly 14*a*. Instead of an electromotive drive unit, an electromagnetic drive unit 64*a* is provided in the second embodiment, which electromagnetic drive unit comprises a magnetic coil, of which only a coil body 66*a* is shown in FIG. 6*a*, and an armature plunger 68*a*. The armature plunger is coupled with the locking slider 44*a* in a shear- and tensile-force-transmitting manner, for example by means of an interlocking connection. The magnetic coil is controlled by the control unit of the washing machine in a pulsed manner, that is to say a first control pulse (corresponding to a short-time excitation of the magnetic coil) serves to transfer the locking slider 44*a* from its unlocking position into the locking position and a subsequent second control pulse (again corresponding to a short-time excitation of the magnetic coil) serves to return the locking slide 44*a* from the locking position into the unlocking position. During this return movement, the locking slider 44*a* passes through its opening position, so that the door latch 10*a* is force-opened in the course of unlocking.

Unlike in the first embodiment, in which the locking slider 44 can also be held stably in it's opening position by stopping the drive motor 46, the locking slider 44*a* in the second embodiment passes through the opening position only transitorily and cannot be stably moved into the opening position (with pulsed operation of the electromagnetic drive unit 64*a*). A sliding guide 70*a*, in conjunction with a biasing spring 72*a*, ensures that the locking slider 44*a* switches between the unlocking position and the locking position on successive control pulses for the electromagnetic drive unit 64*a*. The sliding guide 70*a* comprises a sliding guide path 74*a* and a path follower 76*a*, which in the example shown is formed by a piece of wire and moves around a central island 78*a* in the sliding guide path 74*a*. In the example shown, the sliding guide path 74*a* is formed on the locking slider 44*a*, the path follower 76*a* being supported in a manner not shown in detail on a housing component of a latch housing of the door latch 10*a*. Alternatively, the path follower 76*a* can be supported on the locking slider 44*a* and the sliding guide path 74*a* can be formed on such a housing component.

By stable abutment of the path follower 76*a* on the central island 78*a*, one of the two positions of the locking slider 44*a*: locking position and unlocking position, is defined, and by stable abutment of the path follower 76*a* on a path end portion 80*a* of the sliding guide path 74*a*, the other of those two positions is defined. The biasing spring 72*a* exerts a bias on the locking slider 44*a* such that it can be moved out of both positions (locking position, unlocking position) in each case only against the spring force exerted by the biasing spring 72*a*. In the example shown, the central island 78*a* defines the unlocking position of the locking slider 44*a*. If the electromagnetic drive unit 64*a* is excited in a pulsed manner, it pulls the armature plunger 68*a* into the magnetic coil. The path follower 76*a* thereby reaches a first path portion 82*a* as a result of a suitable form of the inner and outer delimiting surfaces of the sliding guide 74*a*. At the end of the control pulse, the biasing spring 72*a* pushes the locking slider 44*a* to the right in the representation of FIG. 6*a*, the path follower 76*a* in the first path portion 82*a* sliding past the central island 78*a* as far as the path end portion 80*a*. Abutment of the path follower 76*a* against the path end portion 80*a* stops the movement of the locking slider 44*a*; it has then reached its locking position.

Figure 6A:
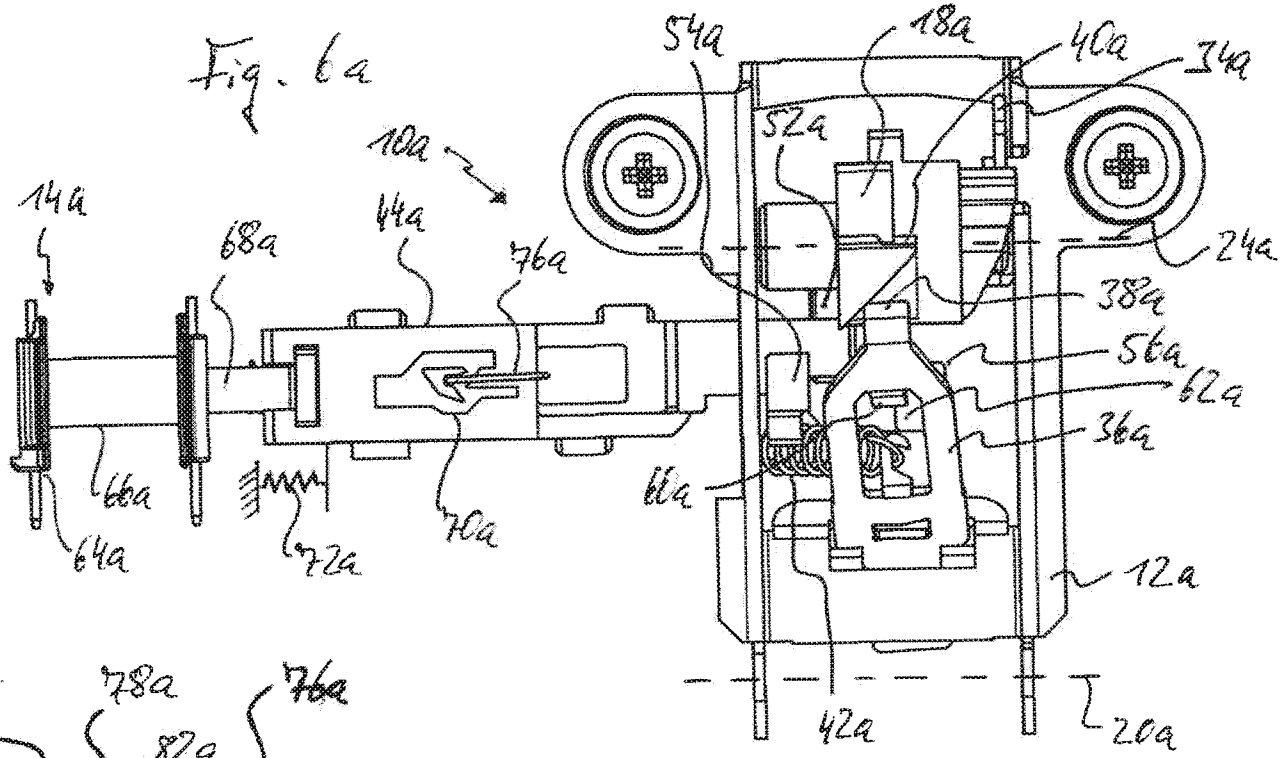
FIG. 6*a* shows a door latch according to a second embodiment.
Figure 6B:
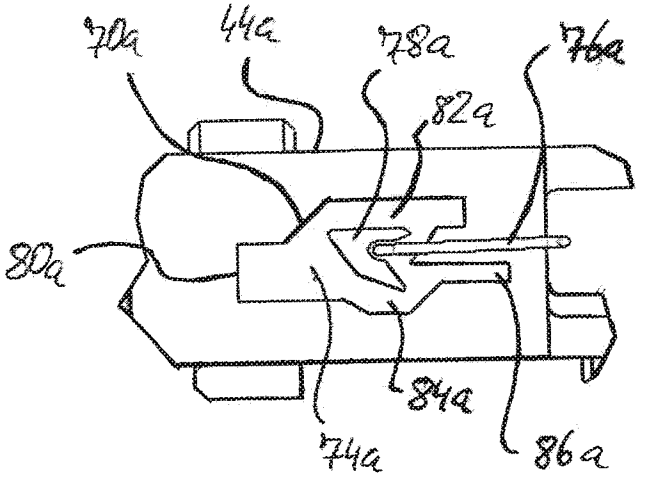
FIG. 6*b* shows a detail of the door latch of the second embodiment in a perspective view.

A subsequent second control pulse for the electromagnetic drive unit 64*a* causes the armature plunger 68*a* to be pulled into the magnetic coil again and—associated therewith—the locking slider 44*a* to move to the left in the representation of FIG. 6*a*. The path follower 76*a* thereby reaches a second path portion 84*a*, which passes the central island 78*a* on the opposite side—relative to the first path portion 82*a*. The second path portion 84*a* is longer than the first path portion 82*a*; it has a path extension 86*a* into which the path follower 76*a* moves in the case of the movement stroke of the locking slider 44*a* effected by the second control pulse. The locking slider 44*a* thereby moves sufficiently far to the left (in the representation of FIG. 6*a*) that the release structure 56*a* (more precisely the release ramp formed by the release structure 56*a* but not visible in FIG. 6*a*) meets the tongue 60*a* of the catch 36*a* and thus causes forced-opening of the door latch 10*a*. After the end of the second control pulse, the locking slider 44*a* moves to the right (in the representation of FIG. 6*a*) again under the force of the biasing spring 72*a*, the path follower 76*a* moving out of the extension 86*a* again and coming into stable abutment on the central island 78*a*.

The temporary movement of the path follower 76*a* into the extension 86*a* corresponds to a transitory pass through the opening position of the locking slider 44*a*. The first path portion 82*a* does not have an extension corresponding to the extension 86*a*, that is to say it is shorter than the second path portion 84*a*. In this manner it is ensured that, upon locking, that is to say when the locking slider 44*a* is transferred out of the unlocking position into the locking position, the locking slider 44*a* does not also pass through its opening position during its movement and thus effect unintentional forced-opening of the door latch 10*a*.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A door latch for an electrical domestic appliance, in particular a laundry treatment, the door latch comprising:

a rotary member which is arranged to be rotationally movable between a closing rotational position and a release rotational position and is spring-biased in the direction towards the release rotational position and which, in the closing rotational position, holds a closure member in order to keep a door of the domestic appliance closed and, in the release rotational position, releases the closure member in order for the door to open;

a movably arranged catch for arresting engagement, which is releasable by an overlifting rotational movement of the rotary member, with the rotary member in the closing rotational position thereof; and a locking assembly having a locking member which is arranged to be movable, when the door is closed, between an unlocking position and a locking position and which blocks at least one movable component of the door latch in the locking position and releases that component in the unlocking position, wherein the locking member is movable, starting from the locking position, beyond the unlocking position into an opening position, wherein, when moved into the opening position, the locking member causes the arresting engagement of the catch with the rotary member to be released by lifting the catch out of contact with the rotary member to thereby render the rotary member free to rotate from the closing rotational position into the release rotational position.

2. The door latch according to claim 1, wherein the locking member is stably movable into the opening position.

3. The door latch according to claim 2, wherein the locking assembly comprises an electric drive motor for driving the locking member.

4. The door latch according to claim 1, wherein the locking member, for stable movement into the unlocking position, performs a forced pass through the opening position, starting from the locking position.

5. The door latch according to claim 4, wherein the locking assembly comprises an electromagnetic drive unit for driving the locking member, the locking member having an associated sliding guide defining the unlocking position, the locking position and the opening position.

6. The door latch according to claim 1, wherein the locking member cooperates directly with the catch.

7. The door latch according to claim 1, comprising a release structure, which cooperates with the catch and is movable into the opening position independently of a movement of the locking member, for releasing the arresting engagement of the catch with the rotary member by means of a sloped-surface engagement between the release structure and the catch.

8. The door latch according to claim 1, further comprising a release structure that cooperates with the catch and is movable into the opening position for releasing the arresting engagement of the catch with the rotary member by a sloped-surface engagement between the release structure and the catch, wherein the release structure is formed on the locking member or on a release member which is separate from the locking member and the movement of which is controlled by the locking member.

9. The door latch according to claim 1, wherein the locking member, in the locking position, blocks the rotary member against rotation into the release rotational position and/or blocks the catch in at least one movement direction.

10. A door latch for an electrical domestic appliance, the door latch comprising:

a rotary member which is arranged to be rotationally movable between a closing rotational position and a release rotational position and is spring-biased in the direction towards the release rotational position and which, in the closing rotational position, holds a closure member in order to keep a door of the domestic appliance closed and, in the release rotational position, releases the closure member in order for the door to open;

a movably arranged catch for arresting engagement, which is releasable by an overlifting rotational movement of the rotary member, with an arresting edge of the rotary member in the closing rotational position thereof to thereby prevent the rotary member from rotating back in the direction towards the release rotational position; and a locking assembly having a locking member which is arranged to be movable, when the door is closed, between an unlocking position and a locking position and which blocks at least one movable component of the door latch in the locking position and releases that component in the unlocking position, wherein the locking member is movable, starting from the locking position, beyond the unlocking position into an opening position, wherein, when moved into the opening position, the locking member causes the arresting engagement of the catch with the arresting edge of the rotary member to be released by lifting the catch out of contact with the arresting edge of the rotary member to thereby render the rotary member free to rotate from the closing rotational position into the release rotational position.

* * * * *